US008907572B2

(12) United States Patent
So

(10) Patent No.: US 8,907,572 B2
(45) Date of Patent: Dec. 9, 2014

(54) CENTRALIZED LED BASED HIGHWAY LIGHTING SUPPLY AND CONTROLS AND RELATED METHODS

(71) Applicant: Ting Pat Albert So, Bothell, WA (US)

(72) Inventor: Ting Pat Albert So, Bothell, WA (US)

( * ) Notice: Subject to any disclaimer, the term of this patent is extended or adjusted under 35 U.S.C. 154(b) by 0 days.

(21) Appl. No.: 13/987,961

(22) Filed: Sep. 19, 2013

(65) Prior Publication Data

US 2014/0139118 A1 May 22, 2014

Related U.S. Application Data

(60) Provisional application No. 61/796,752, filed on Nov. 19, 2012.

(51) Int. Cl.
*H05B 37/00* (2006.01)
*H05B 33/08* (2006.01)

(52) U.S. Cl.
CPC ..... *H05B 33/0803* (2013.01)
USPC ..... 315/160; 315/312; 315/362

(58) Field of Classification Search
None
See application file for complete search history.

(56) References Cited

U.S. PATENT DOCUMENTS

| | | | | |
|---|---|---|---|---|
| 6,028,597 | A * | 2/2000 | Ryan et al. | 345/211 |
| 2012/0230696 | A1 * | 9/2012 | Pederson et al. | 398/115 |
| 2014/0028200 | A1 * | 1/2014 | Van Wagoner et al. | 315/158 |

* cited by examiner

*Primary Examiner* — Jany Richardson
(74) *Attorney, Agent, or Firm* — Kyle Rozema

(57) ABSTRACT

An LED based lighting system for use in highway lighting, adaptations to current highway lighting systems, and associated methodology. The highway lighting system can be implemented in new highway installations and also by retrofitting existing highway installations. Unlike highway lighting systems in the prior art that convert AC to DC and clean the harmonics at each lamp post, the lighting system converts AC to (high voltage) DC and cleans the created harmonics at a centralized location thereby supplying high voltage DC to each lamp. The high voltage DC is then stepped down at each lamp post via communicating with centralized command center. This allows each lamp to be dimmed from full brightness to 0% brightness and also to be dimmed independent of one another (which in turn allows for automatic checking whether each lamp is functioning properly).

4 Claims, 1 Drawing Sheet

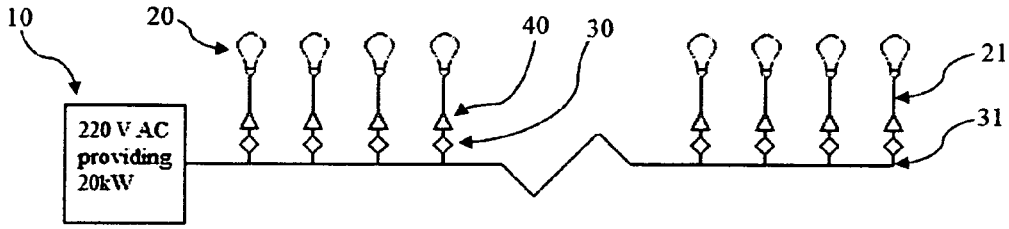
Figure 1: An example of a typical 2 km section of highway lighting
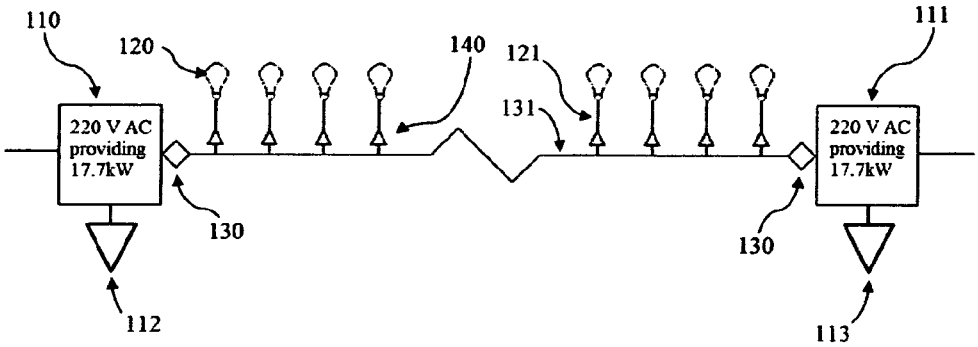
Figure 2: An example diagram of the highway lighting system

CENTRALIZED LED BASED HIGHWAY LIGHTING SUPPLY AND CONTROLS AND RELATED METHODS

CROSS REFERENCE TO RELATED APPLICATIONS

The present application is a non-provisional patent application claiming the benefit of priority under 35 U.S.C. §119 (e) from U.S. Provisional Application No. 61/796,752 filed on Nov. 19, 2012, the entire contents of which are hereby expressly incorporated by reference into this disclosure as if set forth fully herein.

BACKGROUND OF THE INVENTION

1. Field of Invention

The present invention relates to a highway lighting system, adaptations to current highway lighting systems, and associated methodology. More specifically, the highway lighting system aspect of the present invention involves converting AC to DC power and removing harmonics centrally in a way to efficiently power and to control individually LED highway lamps. In effect, the highway lighting system aspect of the present invention is able to utilize the methodology aspect of the invention to automatically test whether individual LED lamps are functioning properly. Moreover, the present invention allows for the implementation of new highway installations and also for retrofitting existing highway installations.

2. Discussion of the Prior Art

Highway and freeway street lighting systems usually place a lamp post every 50 m apart. Depending on the required lighting in each particular use, the lamps can be along the middle line of the road or on both sides of the road. While highway and freeway street lighting may appear to be controlled on a single grid, the entire lighting grid is usually split up and controlled in approximately 2 km sections. In any given 2 km section, all the lighting is powered by a single power supply (this is at least in the case in China, Europe, and many other countries). That means for every 2 km section there are 40 lamps posts on the middle line of or both sides of the highway. Depending on the amount of lighting required for the particular application, each lamp post can contain any lighting capacity, i.e., each lamp post could have any number of lights but they are normally turned on and off at the same time in one group.

The standard type of lights used at each lamp has recently changed. High Intensity Discharge (HID) lights, such as High Pressure Sodium and Metal Halide etc. were the mainstream type of light used for highway lighting until around 2010 at which point the standard became Light Emitting Diodes (LED). LED lighting provides at least two main benefits over HID lighting: (a) LED is energy saving, and (b) LED is easier to dim. There are a number of practical differences between using HID and LED in highway lighting. One main difference is that LED lighting requires direct current (DC) of lower voltage, say around 50 V, while HID requires alternating current (AC). This is notable due to the fact that the existing power distribution is in AC. Even if the LED light is energized by a 110 V or 220 V AC, the power needs to be converted to DC at around 50 V or below to be directly fed to the LEDs. Two world standards of AC wiring distribution are common. In Europe, China, Hong Kong and many countries, a three phase AC-4 wire (i.e., three hot AC wires plus a neutral wire) (220/240 V single phase-380/415 V three phase) system is utilized. In North America, the secondary services could be a three phase AC-4 wire (277/480 V), or single phase AC-3 wire (120/240 V) or single phase AC-3 wire (240/480 V) system. No matter what system is adopted, the HID uses a single phase AC, which means at every HID lamp post only two wires go in (e.g., one phase wire and the neutral) regardless of whether the three phase AC or single phase AC distribution is used.

The lighting standard move from HID to LED does not simply require replacing a HID light with a LED light. Rather, because LED uses DC while the existing HID uses AC, the conversion thus requires converting the existing AC to DC. The typical LED lighting alongside highways only requires around 50 V DC, so the converter box at each lamp post has to convert the 120 V, 220 V or 240 V AC to 50 V DC in whatever country. The power supply of existing LED based highway lamps at the lamp post is normally in single phase of alternating current ranging from 220 V in Hong Kong, 240 V in Australia and Britain, and 277 V in the U.S.A. Even though energy is lost during the AC to DC conversion, the energy saved by using LED lighting is still considered worthy.

The energy savings from LED do not come without its disadvantages. Recall that with the conventional HID approach, highway lighting system does not require electronics basically, i.e., there is no controller because HID uses AC as design. For LEDs, substantial electronics consisting of lots of active components is needed for the voltage conversion, rectification and control. Electronics creates unwanted harmonics because they are non-linear active components. There is no possibility of the HID lighting system to create harmonics as basically no electronics is involved. However, introducing LED lighting requires a controller which in turn generates harmonics. And because governments heavily regulate the power quality in terms of Total Power Factor and Harmonics Distortion (i.e., the issue of power quality deals with the amount of harmonics created by the load such as a lamp, controller, or anything that uses electric power), government regulation requires harmonics to be reduced, so the controller in LED lighting must remove some amount of the harmonics (depending on the specific regulations). That the controller at each lamp must regulate the harmonics created, which consumes a certain amount of energy, is a second source of energy consumption leading to less efficiency in modifying HID lighting to LED lighting.

To be concrete, consider the following example to demonstrate the loss of energy in a typical LED lighting system. FIG. 1 provides a diagram of a 2 km section of highway lighting powered by a single 220 V AC power source 10, and containing forty LED lights 20, AC to DC converter 30, and harmonics removal devices 40. Assuming voltage drop away from the power supply 10 is negligible, notice that each of the forty lamps receives an input of 220 V AC from the power source, which is located at the location labeled 31, and must be converted to 50 V DC for the 0.4 kW LED lamps. However, notice that because, for example, 0.1 kW are consumed in each of the controllers (i.e., the controller here consists of an AC to DC converter 30 and harmonics removal device 40, where each lamp and controller consumes 0.5 kW), the LEDs themselves only consumes 0.4 kW. At location 21 below, there is a 50V DC. The total efficiency of the system is 80%, which is found by dividing the energy emitted as light (i.e., the 0.4 kW per lamp multiplied by the 40 lamps equals 16 kW) by the energy consumed (i.e., 0.5 kW per lamp and controller multiplied by 40 lamps equals 20 kW).

One observation should be made regarding FIG. 1. Notice that the diagram assumes each lamp's controller will receive 220 V AC. That is, the voltage supplied to each controller down the line is uniform. Realistically, a voltage drop will occur as the distance away from the power supply increases because wires naturally have some resistance, where the last lamp post will have a slightly lower input voltage. Given that each controller will use the same AC to DC converter and there is no automatic voltage regulation within each controller, the voltage supplied to the lamps will decrease as the distance from the power supply increases. Accordingly, the lamp closest to the power supply will be slightly brighter than the lamp one away from the power supply, and the lamp one away from the power supply will be slightly brighter than the lamp two away from the power supply, and so on, with the lamp furthest away being the dimmest. Directly after the last (dimmest) lamp will come another lamp which is the first lamp supplied by a different power supply, so the dimmest lamp from one power supply will be located next to the brightest lamp of another power supply.

Five more observations deal with the arrangement of the power supply and the controllers. First, notice that one power supply is responsible for all lamps within the 2 km section. Therefore, if the power supply of one 2 km section fails, all lamps will be off until that power supply is fixed. There is no backup power supply that could provide power to the lights while the other power supply is in maintenance.

Second, the power supply simply provides one function: to supply power while the converter inside each controller is only responsible for converting AC to DC. Thus, there is no individual control of each of the 40 or so lamps from the centralized power supply. Without each lamp being individually controlled, there is no way to dim one lamp in a 2 km section of highway without dimming all lamps in the entire 2 km section of the highway. Individual dimming control could be useful for a number of reasons, including to save energy and for safety. For example, the brightness of lamps nearest to off and on ramps, or other breaks in the highway, in construction areas, etc. could be set higher than the brightness of lamps in areas that do not require such high brightness.

The third observation relates to how the entire 2 km section of lighting would be dimmed at the same time, namely, by reducing the power supplied from the power supply. However, due to the placement of AC to DC converter (i.e., at each controller), the setup only allows for limited dimming of up to around 30%. It is because the converter circuit needs at least some voltage to function and therefore the voltage of the general power supply of the whole 2 km section could not get too low or else, the converter will not function at all.

The fourth observation also relates to power supply only supplying power: there is at present an absence of a centralized way to monitor which lamps are functioning properly. At present, human inspectors drive around at night and manually check to see if the lamps are functioning properly (i.e., by checking to see if each light has failed or is flickering) and therefore need to be replaced.

The fifth observation relates to the voltage of power transmission. It can be seen that the single phase AC voltage only goes up to a top limit of 277 V and it could sometimes be down to 120 V. It is well aware that the higher the transmission voltage is, the lower the loss along the transmission line is because the current flowing only the line is lower and thus generating less heat due to cable resistance.

The present invention addresses the need for a more efficient way for LED highway street lighting systems to (a) use a higher voltage of transmission along the 2 km sector, (b) convert AC to DC centrally instead of locally at the lamp post, (c) deal with the harmonics created centrally, (d) transmit power to the lamps, (e) overcoming the non-uniform brightness among the LED lighting created by the slight drop in voltage due to the resistance of the power wires, (f) save energy by being able to dim the LED lights independently of one another while maintain the highway safety standard, (g) inspect whether every LED light is functioning properly, (h) receives remote commands from a central station of the city to turn on/off, dim and check the health of LED lights.

SUMMARY OF THE INVENTION

The present invention involves an LED based lighting system for use in highway lighting, adaptations to current highway lighting systems, and associated methodology. The AC to DC power conversion centrally takes place at the power supply, so that only one AC to DC converter is needed for every 2 km section of highway lighting. The harmonics removal also centrally takes places at the power supply, so that the power is cleaned only one time for 40 or 80 LED lamps within one 2 km section. According to an aspect of the invention, the power supply and AC to DC power converter serves a higher DC voltage (such as 400V DC) to each of the lamps.

According to an aspect of the invention, the high transmission voltage thus allows for advanced dimming capability of the LED lights, which is to take place at the LED lamp on an individual lamp basis (as opposed to dimming at the power supply which dims the entire 2 km section of lamps). The capability of dimming every lamp independently allows some sections of the roadway to be brighter than other sections of the highway to enhance safety, and allows for an automatic inspection of individual lamp failures. According to an aspect of the invention, the automatic inspection system operates, when the lamps are not being used, by independently illuminating one lamp, measuring the current at the power supply, using this power consumption to judge whether the lamp is functioning properly, and, if not, storing or sending a notifying signal to a central city based station by a radio network, or both, that maintenance of the specific lamp is required. Since checking the power consumption is on a lamp-by-lamp basis, the precision is much higher. If all lamps are turned on a the same time, it is impossible to discover one or a few failures. If the checking circuit is built inside very lamp post, the cost will be very very high.

According to an aspect of the invention, each 2 km section of lighting will use two separate power supplies at two pavilions, each at one end of the section, so that if one fails the lights will remain normal. Inside each pavilion, there are power supplies and command controllers. The two power supplies energize the 2 km section simultaneously and will be located opposite of each other, which alleviates some of the voltage drop problem that takes place at the end of the one power supply lighting system. Since the same 2 km section is energized by two power supplies at the same time. The other one immediately picks up the job of energization even when one fails. This is called "power hot standby". According to an aspect of the invention, the command controller inside every pavilion is of one of two types, i.e. master and slave. Normally, the master controller issues commands (i.e., for issuing commands such as turning on/off, dimming down, or checking for individual lamp failure, etc) to every light. That at the other end is a slave controller that immediately picks up the control responsibility when the master fails. This is called "command hot standby". However, from a power point of view, there is no master or slave where both power supplies energize the 400 V transmission line at the same time. The configuration is that masters and slaves are distributed regularly along the highway, in the order master-slave-master-slave and so on. Each master is monitoring and energizing two 2 km sections at both sides (upstream and downstream) along the highway while each slave is also monitoring and energizing two 2 km sections at both sides along the highway. Since the voltage level of transmission is much higher than that utilized by the LED lights, the LED lights are insensitive to any slight voltage drop along the transmission line.

According to an aspect of the invention, the system allows existing cables in old, already installed lamp systems to be reused and re-grouped because basically, one two wires are needed for DC transmission versus 3 or 4 wires for AC transmission, i.e., they do not need to be replaced if the system is modified to use the present invention. This is because 400 V DC is of the same voltage grade as the 120 V, 220 V, 240 V or 277 V AC from the cable specification point of view. Also, a higher voltage of transmission means lower current. So, the capacity of existing cables must be adequate for the new power transmission. On the other hand, when the present invention is utilized alongside a new highway (or anytime it is installed without a lighting system in place) it requires installing new cables only a fraction of current carrying capacity of cables as compared to the conventional arrangement.

According to an aspect of the invention, a robust, simple and noise resistant set of tailor made communication protocols on a radio wave spectrum is developed so that the command controller can issue commands to control every light along the 2 km section independently. Such commands are injected by the command controller onto the DC line for pick-up by the in-lamp-post controller of every light. Hence, the protocols provide address identification.

According to an aspect of the invention, the command controller at every pavilion can communicate bi-directionally and continuously with a city based station for proper control, checking and reporting, and it has a traffic detection function and daylight brightness detection function to properly dim down the lights when the traffic flow if less during mid-night.

BRIEF DESCRIPTION OF THE DRAWINGS

FIG. 1 is a diagram of a 2 km section of highway lighting powered by a single 220 V AC power source, and containing forty LED lights, AC to DC converters, and harmonics removal devices.

FIG. 2 is a diagram of a highway lighting system including a master power supply, a secondary power supply, a master controller, a backup or slave controller, High Voltage DC unit, a DC voltage reducer and controller, and forty LED lamps.

DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. The LED based lighting system for use in highway lighting, adaptations to current highway lighting systems, and associated methodology disclosed herein boasts a variety of inventive features and components that warrant patent protection, both individually and in combination.

FIG. 2 is a diagram of a highway lighting system including a master power supply 110, a secondary power supply 111, a master controller 112, a backup or slave controller 113, High Voltage DC unit 130 (which, among other tasks discussed below, converts AC to DC power producing high voltage DC), a DC voltage reducer and controller 140, and, by way of example only, forty LED lamps 120. Note that the master controller 112 or the backup controller 113, or both, have the capability of communicating with a centralized station which communicates with other controllers via a wireless network.

Recall that existing products for highway street light dimming include lowering the transmission voltage of AC by no more than 10 to 20 percent of full brightness, which is done at the power supply. Because dimming is done at the power supply in conventional lighting systems, too low for the transmission voltage for dimming, say to 30% or less will actually turn off the LEDs. The present invention maintains a constant 400 V transmission at all times, which is supplied by two power sources, a main power source 110 and a second power source 111, so each lamp can be individually dimmed from full brightness to 0% brightness via the DC reducer mechanism 140. Note that the names master power source 110 and secondary power source 111 do not refer to how the power is supplied because each supplies the same amount of power at 400 V DC. Each power supply is adequate in supplying the whole section alone, in case. The names are due to where the main controller and slave controller is located, which will be discussed below.

For clarity, notice that at location 131, there is always a constant 400 V DC. The supply between the power supply and various LED street lamps is connected by two cores of conductors only; one for positive polarity and the other for negative polarity, at 400 V DC. Since the output voltage is 400 V DC, as compared with 120V, 220 V, 240 V or 277 V AC, the DC voltage is nearly 90% higher than AC voltage on average. This implies that the same current capacity of cables can conduct nearly 90% more power than the conventional installation. Therefore, this design of the invention reduces material consumption, i.e. less usage of copper. At the same time, installation work load can proportionally be reduced.

Overall, maintaining the higher voltage until at each of the lamps results in a more efficient transmission. The DC power reducer and controller 140 then reduces the 400 V DC to a lower voltage to achieve a brightness in which the command controller at the power supply 112 communicates it to achieve. Thus, instead of reducing the transmission voltage at the power supply (i.e., reducing the voltage for all lamps) as in the prior art, the present invention does the dimming at each of the individual controllers 140. In doing so, every lamp can be dimmed differently. Independent dimming of lamps 120 has at least two advantages over the current system. First, and obviously, it allows for some portions of the roadway to be brighter than other portions, for safety purpose. The second relates to a problem with the present system of inspection of lamp failures, namely, inspectors drive around at night and manually check to see if the light bulbs have failed or flickering and need to be replaced. According to an aspect of the invention, the current system allows for an automatic inspection of individual lamp failures without the need of manually observation. The automatic inspection system only works during when the lamps are not being used. The way is to independently light up one lamp, measure the current at the power supply, and then use this power consumption to judge whether or not the lamp is healthy. This information can then be used to maintain lamps not functioning properly. Because the current rating of measurement is only for one lamp, precision is more accurate.

According to an aspect of the invention, the master controller 112 communicates with each individual DC voltage reducer and controller 140, so that each lamp 120 can be dimmed independent of other lamps 120. The master controller 112 also communicates remotely with the commander (either a human or a computer) of a city based station, who, for example, can turn on/off or change the brightness of any of the lamps 120 from a remote location. The advantage here is that the current invention, when used on a large scale, allows for a single user to control all the lights along entire highways, or even in all the highways in cities or any scale. When the master controller 112 is functioning properly, the backup or slave controller 113 does not control any of the DC voltage reducer and controller 140. Instead, the backup controller 113 acts as a hot-standby backup control unit, i.e., if the master fails the other will pick up immediately. According to an aspect of the invention, the backup control unit 113 may or may not be the master control unit 112 of the next 2 km section of lighting.

Recall that in the conventional street lighting system that if, for example, 0.5 kW reaches the individual controller of a lamp, the controller will only deliver, for example, 0.4 kW to the LED. The loss of 0.10 kW in this example is due to two things: (a) from the energy consumption of the controller to reduce the harmonics; and (b) from converting AC to DC. These two sources account for inefficiency in the prior art. By converting AC to DC and removing the harmonics at the power supply instead of at each individual lamp via a converter and harmonics remover, the present invention can achieve higher efficiency in this process. The prior art LED driver unit at each lamp post usually has a built-in Power Factor Correction (PFC) circuit to improve power factor to nearly 0.98 lagging, an EMI filter to keep current harmonic distortion to around 10% or less, and a fly-back transformer to transform the relatively high AC voltage to a low DC voltage for driving LEDs. This transformation and rectifying process usually decreases system efficacy to around 80% to 85%.

By way of example only, each of the power supplies (i.e., the master power supply 110 and the secondary power supply 111) supplies 17.7 kW. However, this 17.7 kW is split between the 2 km section of lighting shown (serving it with 8.85 kW) and another 2 km section of lighting adjacent to the respective power supply. Similar to the power requirement in FIG. 1, each LED lamp uses 0.4 kW. As opposed to the energy consumption of 0.1 kW to convert AC to DC and remove harmonics at each individual under the conventional system totally 4 kW (as in FIG. 1), the present invention only consumes a total of 1.77 kW because the AC to DC conversion and harmonics removal is only done twice—at the AC to DC power converters 130. Therefore, the efficiency of the present invention in this example is 90%, which is found by dividing the energy emitted as light (i.e., the 0.4 kW per lamp multiplied by the 40 lamps equals 16 kW) by the energy consumed (i.e., 17.7 kW).

According to an aspect of the invention, a control box inside a pavilion is to contain at least the following components: the master power supply 110, master command controller 112, 400 V DC Supply 130. In addition, the control box further contains a microwave motion sensor which emit microwave and receive the reflection to sense movement. As such, the box shall face the highway where the sensor can sense vehicles passing by. The sensor can be used in the automatic dimming of lights depending on the status of highway usage. The control box also has a radio transmitter for communicating with a city based station.

According to an aspect of the invention, there are two types of implementation of the present invention, namely, new installations and retrofitting existing installations. A set of tailor-developed proprietary protocols is developed for the communication between each lamp post and each pavilion and designed to be highly robust and noise resistant. The physical media of the protocols are wired signals of low radio frequency, in kHz ranges. The underlying principle for the new and retrofitted installations is identical. For new installation, one set of cables is laid between two pavilions at both ends of a 2 km highway section. For retrofitting projects, one set of cables is laid 1 km on each side of a pavilion and on each side of the highway. In other words, the power cables of Pavilion A are not connected to power cables of Pavilion B. In this case, the hot standby function is not applicable. However, controls of both arrangements are identical. That means, the master pavilion is able to monitor and control all lamp poles installed along a 2 km highway section on both sides of it. The slave pavilion still continues to monitor signals from the master pavilion. By way of example only, that is achieved by the addition of wireless signals of high radio frequency, in MHz ranges.

By way of example only, each command controller at the pavilion can control up to 196 individual lamps, i.e. 196 lamp posts for one lamp on each post or 88 lamp posts for two independent lamps on each post. This is sufficient to control a 2 km section on one side along the highway and another 2 km section on another side of either a master or slave pavilion, i.e. totally two 2 km sections. It is a kind of unidirectional commanding protocols while the controller of every lamp in each lamp post receives a command from the command controller inside the control box inside the pavilion which receives command from a city based or nation based control station through a wireless 3G network. The commanding signals from the pavilion to the lamps are superimposed on the 400 V DC bus for transmission to all lamps up to a distance of 2 km, either in two circuits (lamp posts on either side of the highway) or one circuit (lamp poles along the middle line of the highway). Two command controllers, one master and one slave, service the same section of 2 km at the same time. But one controller works with two other controllers on both sides (upstream and downstream) along the highway. Each side is a 2 km section.

By way of example only, the inner workings of the controllers, which could be a master or a slave, is as follows. The master command controller always issues commands and listens to its own commands. The slave command controller always listens to commands issued by the master controller. One master controller works with two slave controllers for two 2 km sections, one to the upstream and one to the downstream along the highway. One slave controller also works with two master controllers for two 2 km sections as well. If there is no command received from the master for over a period, say 30 seconds, the slave command controller will assume that the master command controller of the particular 2 km section fails to work and then take over the master and starts to issue commands. The slave controller continues to listen to its own commands as well until the master becomes healthy again. Any command controller, either master or slave, will reset itself (warm boot) or halts itself if it finds out that commands issued by itself are not the same as what are intentional for three times consecutively. Three sub-channels, say A, B and C, of one main channel, say at 400 kHz are used by both the master and slave command controllers of a particular 2 km section while three sub-channels of another main channel, say around 500 kHz, namely D, E and F, are used by the master and slave controllers of the two neighboring 2 km sections of the particular 2 km section. In this way, the sub-channels used by commands on either side of any command controller, master or slave, are different, thus reducing the chance of signal jamming and confusion. Only when there is signal on a particular sub-channel that this sub-channel is considered active. A calm sub-channel is meaningless to any controller. Furthermore, it should be recalled that all lights along two neighboring 2 km section adjacent to the master command controller have an individual address.

By way of example only, every command consists of bits of one of 5 types, namely Begin Bit (BB), Space Bit (SB), "1" (1B), "0" (0B) and End Bit (EB). A Begin Bit (BB) is represented by A+B+C; a space bit is represented by either B or C but not both and no A; a "1" is represented by A+B; a "0" is represented by A+C; an End Bit is represented by A alone. Here, "A" could also mean "D"; "B" could also mean "E"; "C" could also mean "F". As an example, if a lamp receives a bit consisting of two active sub-channels, namely A and B, and one inactive sub-channel, C, the lamps knows that it is a 1B, i.e. "1". In this example, every bit has a duration of 4.5 ms followed by a calm period of 0.5 ms, thus a total of 5 ms. A calm period means that all three sub-channels are inactive. A controller inside the pavilion or a control circuitry inside a lamp pole continuously monitors the three sub-channels under a sampling period of 0.5 ms. A bit is considered valid only when a lamp can receive three successful and consecutive signals within the 5 ms period. For example, if a 1B is to be transmitted, the lamp should be able to receive at least three "A+B" samples consecutively with the sampling period of 0.5 ms. Every bit has to be followed by a space bit, SB, to notify the controller that the transmission of one bit has been completed, ready for another one.

By way of example only, one command consists of 30 bits, namely BB-SB-G-SB-G-SB-G-SB-G-SB-I-SB-I-SB-I-SB-I-SB-CM-SB-CM-SB-CM-SB-PC-SB-PC-SB-EB-SB. Actually, only 15 bits are meaningful while the other 15 bits are for spacing only. Even though no new command is to be issued, a command has to be issued every 10 seconds so that the slave controller knows that the master controller is still alive. Every time when a command is issued, it is automatically repeated to increase the chance of being heard by every lamp. Therefore, if there are 80 lamps altogether within a 2 km section, as a standard design, one lamp for each lamp pole on each side of the road, 50 m apart, serving one 2-km section, and a separate command is issued to each lamp (i.e. suppose the brightness of every lamp is different), the cycling period will be 29 bits per command×5 ms per bit×2 times per command×80 commands=23.2 seconds. But normally, lamp controls are in groups and thus it is possible to control all lamps serving the 2 km section within a couple of seconds. The address of each lamp is denoted by GGGGIIII where G stands for "group" and "I" stands for individual. There can be 14 groups from GGGG=0001 to GGGG=1110. 0000 and 1111 are reserved for special purpose or not for use. Within each group, the lamp address could be from IIII=0001 to IIII=1110, totally 14 lamps. So, total number of lamp addresses is 14×14=196. For example, GGGG=1111 stands for all lamp groups of the 2-km section; IIII=1111 means all lamps within one group. That means, if GGGGIIII=1111 1111, all lamps within the 2 km section are referred to. If all lamps within a specific group is referred to, the address may be GGGGIIII=0110 1111. If a specific lamp is referred to, the address may be GGGGIIII=0110 0011.

The SB could either be sub-channel B or C. To increase sensitivity, it should be complement of the preceding bit. For example, if the preceding bit is a BB or an EB, SB could be randomly chosen to be either sub-channel B or C. But if the preceding bit has a sub-channel B, the SB should be picking sub-channel C and vice versa.

CM stands for command. CM=001 means lowest brightness; CM=010 means Level 1; CM=011 means Level 2; CM=100 means full brightness. CM=111 means the lamp is being turned off. The difference between CM=001 or 111 is that at 001, the contactor of the lamp is still energized while the brightness could be very low subject to the LED driver. At 111, the current driver output is equivalent to CM=001 but the contactor of the lamp circuit is de-energized as well. CM=000, 110 are reserved for future development. CM=101 means that group of lamps or that particular lamp, depending on the lamp address, has to be warm started, i.e. reset. Though the 4 levels could be tuned at factory, they normally represent 0%, 33%, 66% and 100% of full brightness.

In this example, PC stands for parity check. It is used by each controller at the lamp pole to judge whether a command is valid. For a valid command, first of all, the lamp controller inside a lamp pole should have received all 30 bits successfully, and each bit for at least THREE times consecutively, at least 3 out of 8 in a 5 ms period. Second, the totally number of "1" within the command should be divisible by "3". PC PC=00 means zero; PC PC=01 means one; PC PC=10 means two. PC PC=11 is not used. Since GGGGIIII=00000000 and CM=000 are not allowed, there should be at least one "1" inside the address and one "1" inside the CM, if the total number of "1" within G G G G I I I I CM CM CM is 4 for example, PCPC should be equal to 10=two so that when added, the sum will be 6, divisible by 3.

Overall, the design of this set of protocols is fail-safe as well. When one sub-channel fails, either always on or always off, the lamp circuit could never get a successful command.

Having described a multitude of aspects of the present invention, including aspects of the LED based lighting system for use in highway lighting, adaptations to current highway lighting systems, and associated methodology, it should be understood that this invention is not limited to only those aspects described above and that changes and modifications may be made without departing from the true spirit and scope of the invention as defined in the appended claims.

What is claimed is:

1. An LED based lighting system for use in highway lighting, comprising:

(a) two or more LED lamps;

(b) a master power supply having the capability of converting AC to DC power, the capability of removing harmonics, and energizing a grid with cleaned, high voltage DC power intended supply power to two or more LED lamps;

(c) a secondary power supply having the capability of converting AC to DC power, the capability of removing harmonics, and energizing a grid simultaneously with said master power supply with cleaned, high voltage DC power intended supply power to two or more LED lamps, the secondary power supply to be located opposite said master power supply thereby alleviating some of the voltage drop problem that takes place at the end of said master power supply;

(d) a master controller with the means for detecting traffic and daylight brightness; the means for communicating bi-directionally and continuously with one or more centralized stations for proper control, checking and reporting of LED light functioning of each LED light independently; the means for issuing commands to each of two or more LED lights independently, the commands including, but not limited to, turning on/off two or more LED lamps independently, dimming up or down two or more LED lamps independently, or checking for lamp failure of two or more LED lamps independently; the means of monitoring the proper functioning of controllers of other LED lighting systems; and the means for taking control of two or more LED lights of other LED systems over master controller of the other LED systems and issues same said commands to other LED lighting systems;

(d) a backup controller with the means for detecting traffic and daylight brightness; the means for communicating bi-directionally and continuously with one or more centralized stations for proper control, checking and reporting of LED light functioning of each LED light independently; the means for issuing commands to each of two or more LED lights independently, the commands including, but not limited to, turning on/off two or more LED lamps independently, dimming up or down two or more LED lamps independently, or checking for lamp failure of two or more LED lamps independently; the means of monitoring the proper functioning of said master controller and other master controllers in other LED lighting systems; and the means for taking control of two or more LED lights controlled by said master controller and/or other LED systems and issues same said commands to LED lamps usually controlled by said master controller or to other LED lighting systems;

(f) a main pavilion housing said master power supply and said master controller;

(g) a secondary pavilion housing said second power supply and said backup controller, located opposite said main pavilion;

(h) a DC voltage reducer and controller for each of said LED lamps for reducing DC voltage from power grid and supplying voltage to LED lamp; means for receiving commands from said master and said backup controller; and means for interpreting commands to adjust DC voltage supplied to LED lamp.

2. The LED based lighting system of claim 1 and further comprising means for adapting existing highway lighting to conform to basic requirements of claim 1.

3. A method of adapting existing highway lighting systems uncomforting to the LED based lighting system of claim 1 to conform to the LED based lighting system of claim 1, the adaptations comprising:

(a) the addition of one or more of said components of claim 1.

4. The method of adapting existing highway lighting systems of claim 2 and the adaptations further comprising rewiring existing cables of installed lamp systems to conform to requirements of claim 1.

* * * * *